US009259130B2

(12) United States Patent
Deery et al.

(10) Patent No.: US 9,259,130 B2
(45) Date of Patent: Feb. 16, 2016

(54) POOL CLEANER LIGHT MODULE

(75) Inventors: Brian Deery, Cary, NC (US); John Lipski, Raleigh, NC (US); Leonard Richiuso, Raleigh, NC (US); Suresh Gopalan, Cary, NC (US)

(73) Assignee: Pentair Water Prool and Spa, Inc., Sanford, NC (US)

( * ) Notice: Subject to any disclaimer, the term of this patent is extended or adjusted under 35 U.S.C. 154(b) by 791 days.

(21) Appl. No.: 13/488,135

(22) Filed: Jun. 4, 2012

(65) Prior Publication Data

US 2013/0320858 A1 Dec. 5, 2013

(51) Int. Cl.
*H01J 1/60* (2006.01)
*A47L 9/30* (2006.01)

(52) U.S. Cl.
CPC ..... *A47L 9/30* (2013.01)

(58) Field of Classification Search
None
See application file for complete search history.

(56) References Cited

U.S. PATENT DOCUMENTS

| | | | | |
|---|---|---|---|---|
| 3,845,291 | A | 10/1974 | Portyrata | |
| 5,228,964 | A | 7/1993 | Middleby et al. | |
| 5,569,371 | A | 10/1996 | Perling | |
| 5,622,422 | A | 4/1997 | Rodgers | |
| 6,036,333 | A | 3/2000 | Spiller | |
| 6,206,547 | B1 * | 3/2001 | Erlich | 362/276 |
| 6,213,623 | B1 | 4/2001 | Campman | |
| 6,412,133 | B1 | 7/2002 | Erlich et al. | |
| 6,502,269 | B1 | 1/2003 | Balchan et al. | |
| 6,842,931 | B2 | 1/2005 | Porat et al. | |
| 6,885,114 | B2 | 4/2005 | Baarman et al. | |
| 7,060,182 | B2 | 6/2006 | Erlich et al. | |
| 7,143,502 | B2 | 12/2006 | Porat et al. | |
| 7,165,284 | B2 | 1/2007 | Erlich et al. | |
| 7,543,607 | B2 | 6/2009 | Henkin et al. | |
| 7,690,066 | B2 | 4/2010 | Stoltz et al. | |
| 7,845,820 | B2 | 12/2010 | Bertken | |
| 7,900,308 | B2 | 3/2011 | Erlich et al. | |
| 8,618,687 | B2 * | 12/2013 | Burnham | 290/54 |
| 2004/0025268 | A1 * | 2/2004 | Porat et al. | 15/1.7 |
| 2006/0226060 | A1 * | 10/2006 | Mercer | 210/222 |
| 2007/0094817 | A1 | 5/2007 | Stoltz et al. | |
| 2009/0307854 | A1 | 12/2009 | Garti et al. | |
| 2010/0157582 | A1 | 6/2010 | Bertken | |
| 2011/0012356 | A1 | 1/2011 | Burnham | |
| 2011/0064626 | A1 | 3/2011 | Kennedy | |
| 2012/0110727 | A1 | 5/2012 | Uy et al. | |
| 2013/0175802 | A1 * | 7/2013 | Breau et al. | 290/54 |

* cited by examiner

*Primary Examiner* — Cassandra Cox
(74) *Attorney, Agent, or Firm* — Quarles & Brady LLP

(57) ABSTRACT

Embodiments of the invention provide a light module for a pool cleaner. The light module can include a housing, a paddle wheel, a generator, and at least one light emitting diode (LED). The housing can be removably coupled to the pool cleaner and can include a flow directing portion positioned in a fluid path of the pool cleaner. The paddle wheel can be located adjacent to the flow directing portion and can rotate in response to fluid flow through the fluid path. The generator can be coupled to the paddle wheel and can generate power through rotation of the paddle wheel. The LED can be coupled to the generator and can receive the generated power from the generator to illuminate an area adjacent to the pool cleaner.

20 Claims, 9 Drawing Sheets

POOL CLEANER LIGHT MODULE

BACKGROUND

Automatic swimming pool cleaners include components for driving the pool cleaners along the floor and sidewalls of a swimming pool, either in a random or deliberate manner, to vacuum debris on and adjacent to the floor and sidewalls. For example, conventional pressure side cleaners and suction cleaners often use hydraulic turbine assemblies as drive systems to drive one or more wheels. Robotic cleaners often include a motor or other mechanical system powered by an external power source to drive one or more wheels.

Although automatic swimming pool cleaners operate with little manual operator interaction, it is sometimes difficult for the operator to quickly determine whether the pool cleaner is operating correctly or efficiently. For example, an operator can see the pool cleaner moving along a swimming pool floor, but not realize that the cleaner is not vacuuming or barely vacuuming until hours or days later when a substantial amount of debris has settled on the pool floor. This may be due to mechanical malfunctions in robotic cleaners, or insufficient suction or pressure in suction-driven or pressure-driven pool cleaners. Furthermore, an operator must wait to watch whether a pool cleaner is moving to determine if it is operating. If the pool cleaner is scheduled to operate at night, the operator must turn on lights inside or around the swimming pool just to see if the pool cleaner is operating. This can be a tedious task that many operators do not pay attention to and, as a result, these operators do not realize their pool cleaner has not been operating until a substantial amount of debris has settled on the pool floor.

SUMMARY

Some embodiments of the invention provide a light module for a swimming pool cleaner. The light module includes an outer housing, a paddle wheel, a generator, and at least one light emitting diode (LED). The outer housing is capable of being removably coupled to the swimming pool cleaner and includes a flow directing portion positioned in a fluid path of the swimming pool cleaner. The paddle wheel is located adjacent to the flow directing portion and rotates in response to fluid flow through the fluid path. The generator is coupled to the paddle wheel and generates power through rotation of the paddle wheel. The LED is coupled to the generator and receives the generated power from the generator to illuminate an area adjacent to the swimming pool cleaner.

Some embodiments of the invention provide a pool cleaner receiving fluid flow from a pool hose and including a supply mast and a light module. The light module includes a housing capable of being removably coupled to the supply mast and the pool hose and directing fluid flow from the pool hose to the supply mast. The light module also includes a generator positioned inside the housing and a paddle wheel coupled to the generator. The paddle wheel and the generator generate electric power using the fluid flow directed through the housing. The light module further includes at least one light emitting diode coupled to the generator. The light emitting diode receives the generated power from the generator and illuminates an area adjacent to the pool cleaner.

A method of operating a pool cleaner according to some embodiments of the invention includes receiving fluid flow through the pool cleaner and generating electric power using a paddle wheel positioned to receive at least some of the fluid flow and a generator coupled to the paddle wheel. The method also includes determining a pressure of the fluid flow, operating at least one light emitting diode according to a first operation if the pressure is sufficient for normal operation of the pool cleaner, and operating the at least one light emitting diode according to a second operation if the pressure is insufficient for normal operation of the pool cleaner. The first operation and the second operation can include operating the light emitting diode with a first color and a second color, respectively, or in a constantly visible and flashing manner, respectively.

DETAILED DESCRIPTION

Figure 1:
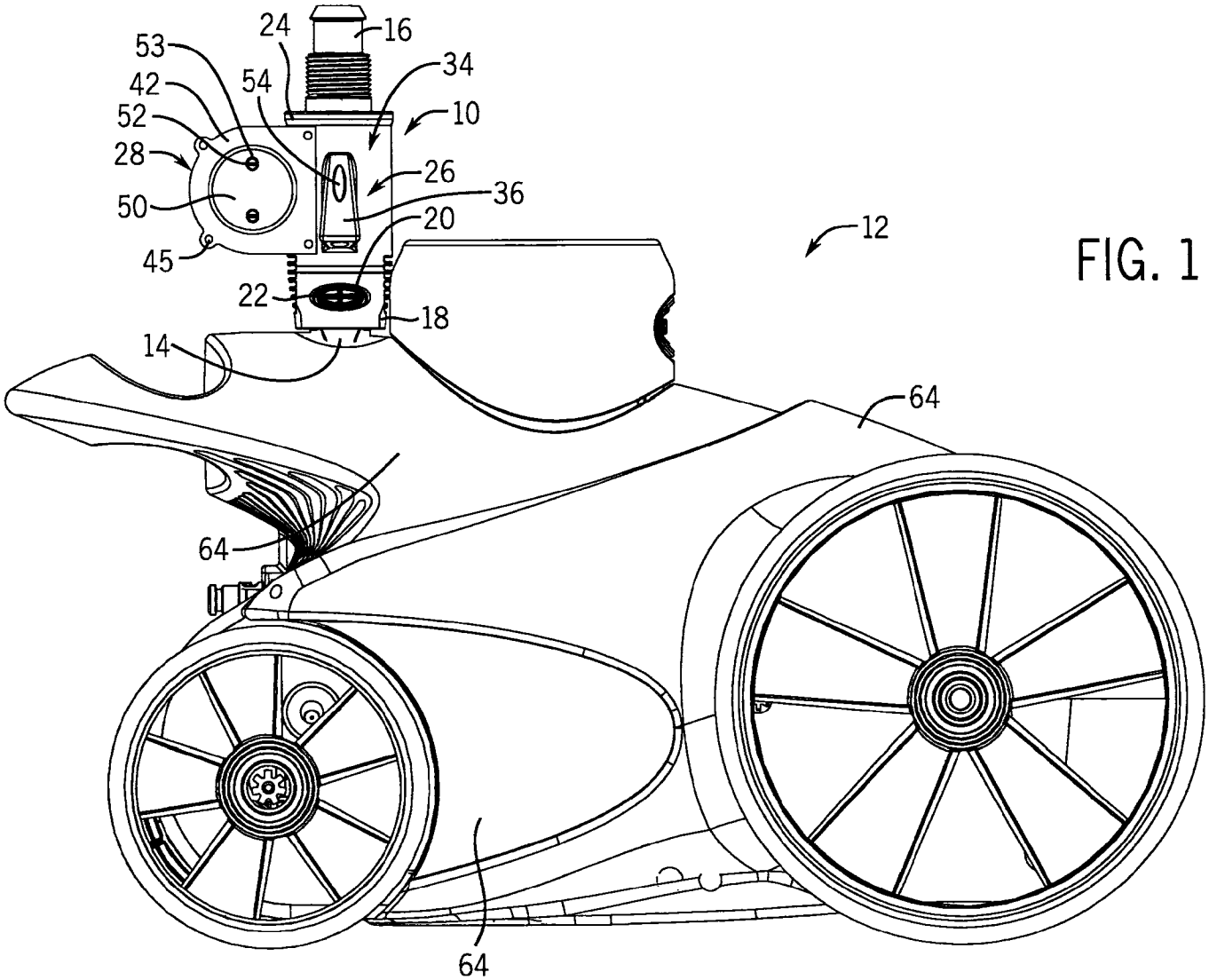
FIG. 1 is a side view of an in-line light emitting diode (LED) module, according to one embodiment of the invention, coupled to a pool cleaner.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Embodiments of the invention provide an LED module for a swimming pool cleaner. The LED module can provide functional and aesthetic uses by illuminating the pool cleaner surroundings, highlighting debris within the swimming pool, and/or conveying information related to the pool cleaner back to a user or operator. The LED module is capable of single color lighting modes, multi-color lighting modes, and/or color change modes. In addition, the LED module can be removably coupled to the swimming pool cleaner internally or externally, as further described below.

Figure 2:
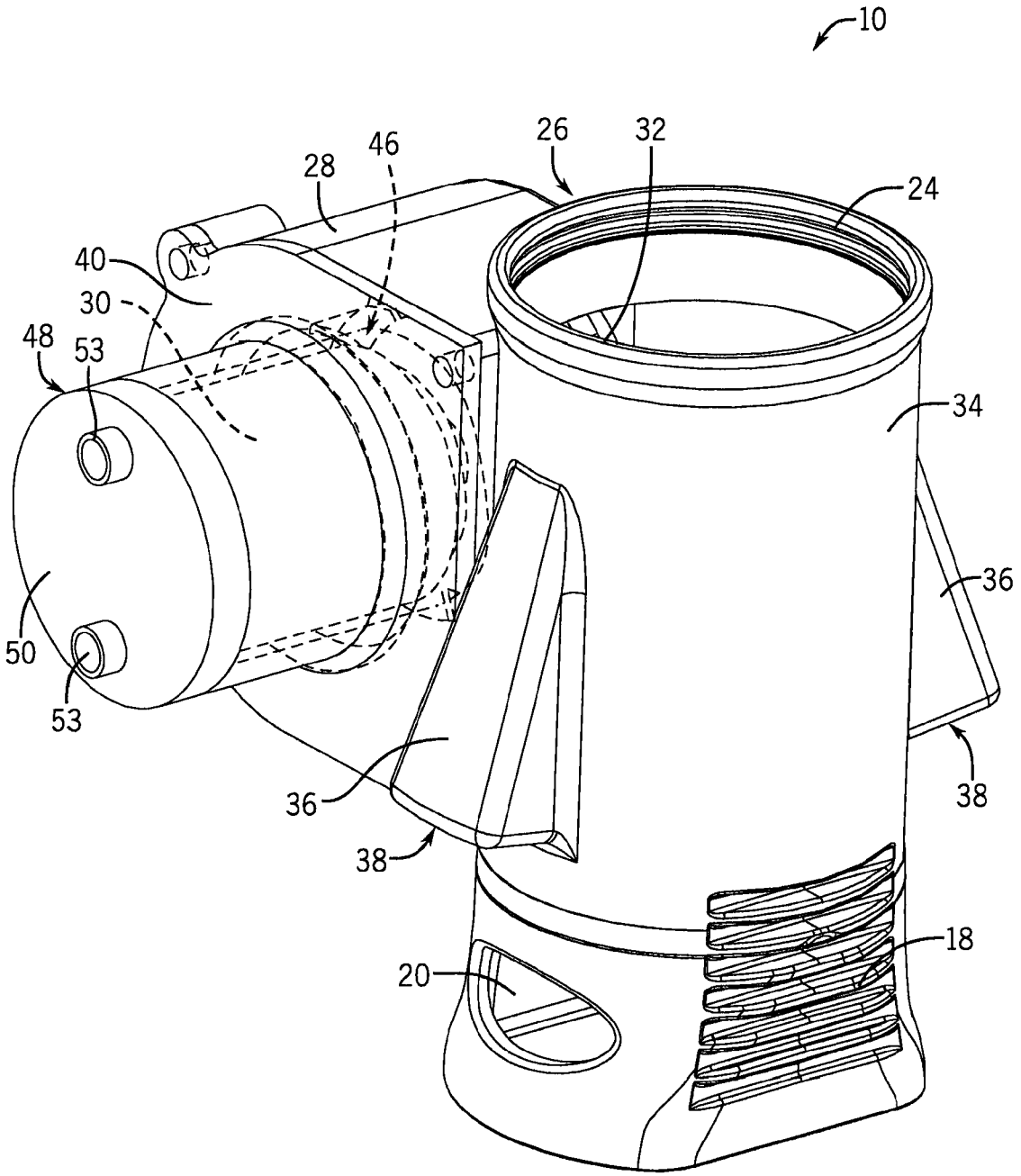
FIG. 2 is a perspective view of the in-line LED module of FIG. 1.
Figure 3:
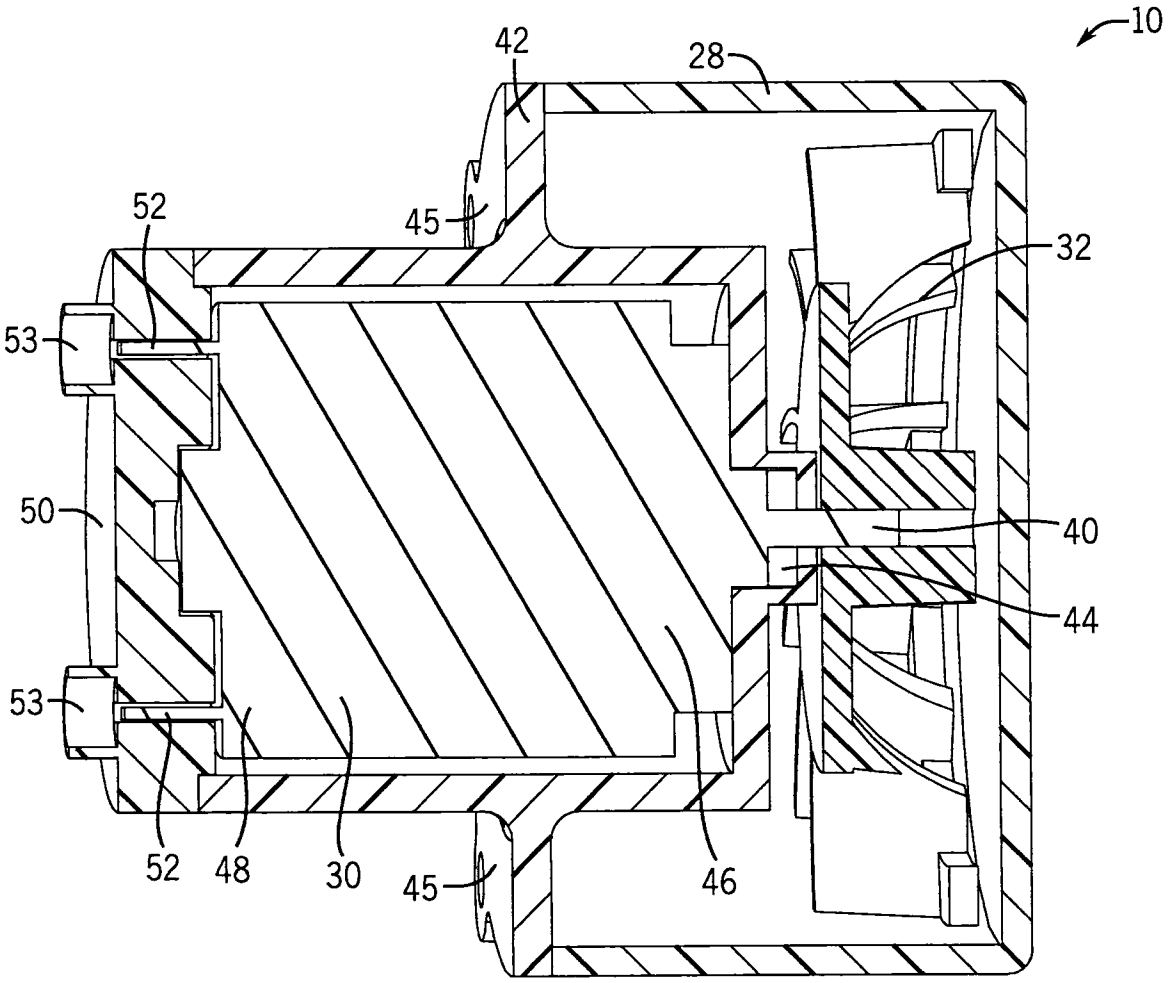
FIG. 3 is a perspective cross-sectional view of the in-line LED module of FIG. 1.
Figure 4:
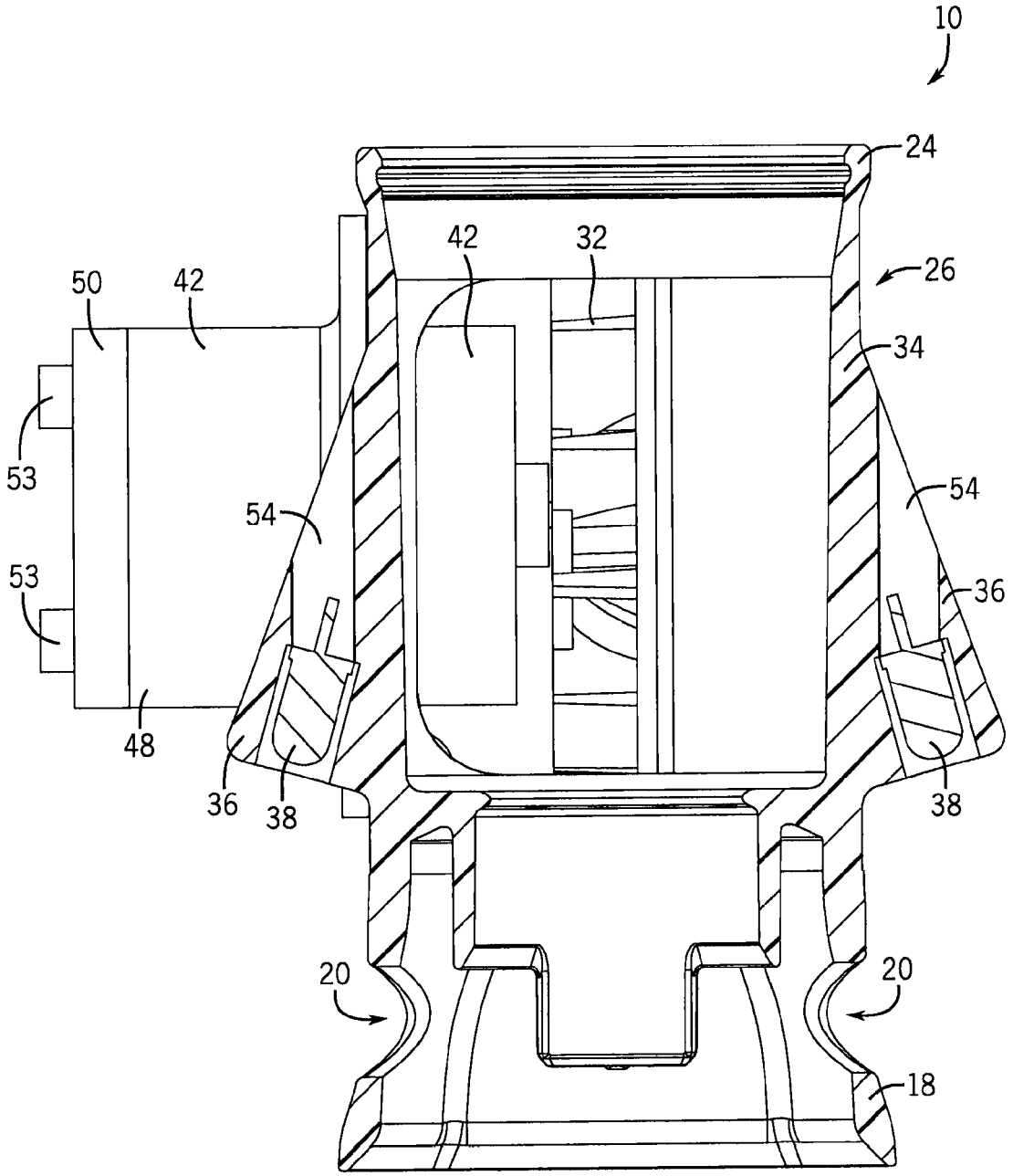
FIG. 4 is a side cross-sectional view of the in-line LED module of FIG. 1.
Figure 9:
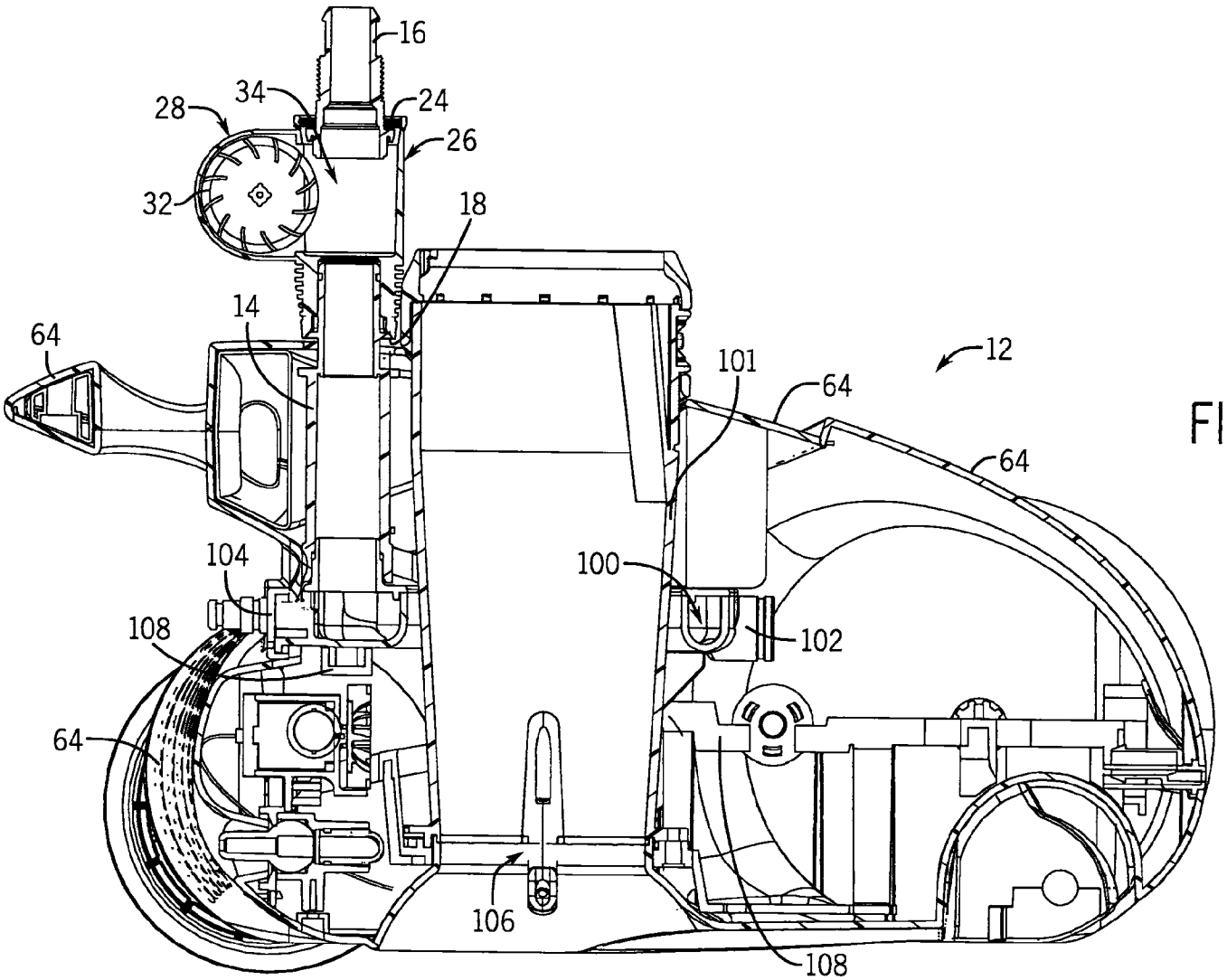
FIG. 9 is a side cross-sectional view of the in-line LED module and the pool cleaner of FIG. 1.

FIG. 1 illustrates an in-line light emitting diode (LED) module 10, according to one embodiment of the invention, for use with a pool cleaner 12 in a swimming pool or spa system. The in-line LED module 10 can be positioned along a fluid path of the pool cleaner 12, for example between a supply mast 14 of the swimming pool cleaner 12 and a pool hose attachment adapter 16. As shown in FIGS. 1 and 2, a bottom portion 18 of the in-line LED module 10 can be coupled to the supply mast 14, for example, through a snap-fit connection between through-holes 20 in the bottom portion 18 and extension portions 22 of the supply mast 14. A top portion 24 of the in-line LED module 10 can be coupled to the pool hose attachment adapter 16, for example, by a friction fit. The pool hose attachment adapter 16 can receive a pool hose (not shown) in fluid communication with a filter pump or a booster pump of the pool or spa system to supply water to the pool cleaner 12. The in-line LED module 10 can include an outer housing 26 with a paddle wheel housing 28, a generator 30, a paddle wheel 32 (as shown in FIGS. 3, 4 and 9), and a tube housing 34. The tube housing 34 can include the bottom portion 18 and the top portion 24, described above, as well as LED housings 36 that at least partially enclose one or more LEDs 38.

In one embodiment, the pool cleaner 12 can be a pressure-driven pool cleaner. As a result, water from the filter pump or the booster pump is driven through the pool hose and into fluid path of the pool cleaner 12 in order to operate the pool cleaner 12. More specifically, water is driven through the pool hose, the hose attachment adapter 16, the tube housing 34 of the in-line LED module 10, and into the supply mast 14. The paddle wheel 32 is substantially positioned within the paddle wheel housing 28 and extends into the tube housing 34. The tube housing 34 acts as a flow-directing portion of the in-line LED module 10 to provide fluid flow from the pool hose to the supply mast 14 and across the paddle wheel 32. Thus, when water flows through the tube housing 34, the paddle wheel 32 is rotated. The paddle wheel 32 is coupled to the generator 30 (e.g., a shaft 40 of the generator 30 is connected to the paddle wheel 32) so that rotation of the paddle wheel 32 hydraulically causes the generator 30 to produce electric power for operating the LEDs 38 and their related circuitry.

As shown in FIG. 3, the generator 30 can be housed within a generator housing 42 that extends into the paddle wheel housing 28. A rubber seal ring 44 can be positioned between a first side 46 of the generator 30 and the paddle wheel 32 (e.g., inside the generator housing 42) to prevent water flow through the tube housing 34 and the paddle wheel housing 28 from reaching the generator 30. The generator housing 42 and the paddle wheel housing 28 can include mating holes 45 for receiving fasteners to couple together the generator housing 42 and the paddle wheel housing 28 and to allow easy removal of the generator 30 for replacement or repair. A second, opposite side 48 of the generator 30 can be enclosed within the generator housing 42 by a lead cover 50, as shown in FIG. 2. As shown in FIG. 3, the lead cover 50 can allow exposure of one or more leads 52 from the generator 30 through lead openings 53. Lead cables (not shown) can electrically connect the leads 52 through the generator housing 42 to the LEDs 38 in order to provide power to the LEDs 38. For example, the lead cables can be routed through access holes 54 in the LED housings 36, as shown in FIGS. 1 and 4.

As shown in FIG. 4, the LEDs 38 can be positioned generally downward and outward and/or the LED housings 36 can be shaped to generally reflect light from the LEDs 38 in a downward and outward manner in order to illuminate the pool cleaner surroundings (e.g., the pool floor or pool walls near the pool cleaner 12). The LEDs 38 can include internal control circuitry programmed to control the illumination time and/or color of the LEDs 38. In some embodiments, external control circuitry for the LEDs 38 and/or other components of the in-line LED module 10 can be housed within the generator housing 42 and the lead cables can provide both power from the generator 30 and control from the control circuitry to the LEDs 38.

In other embodiments, the LEDs 38 can be positioned to illuminate other areas surrounding the pool cleaner 12. For example, the LEDs 38 can be positioned to illuminate upward and/or outward to convey information to a pool user, such as an indication that the pool cleaner 12 is operating or an amount of time the pool cleaner 12 has been operating or has left to operate (e.g., through color changes, flashing, etc.). The downward-facing LEDs 38, as described above, can also achieve this function of conveying information to the user. In addition, in some embodiments, the pool cleaner 12 can be a vacuum-driven pool cleaner, in which water flow through the fluid path of the pool cleaner 12 is reversed with respect to the pressure-driven pool cleaner embodiment described above. In such embodiments, the in-line LED module 10 operates the same as described above.

Figure 5:
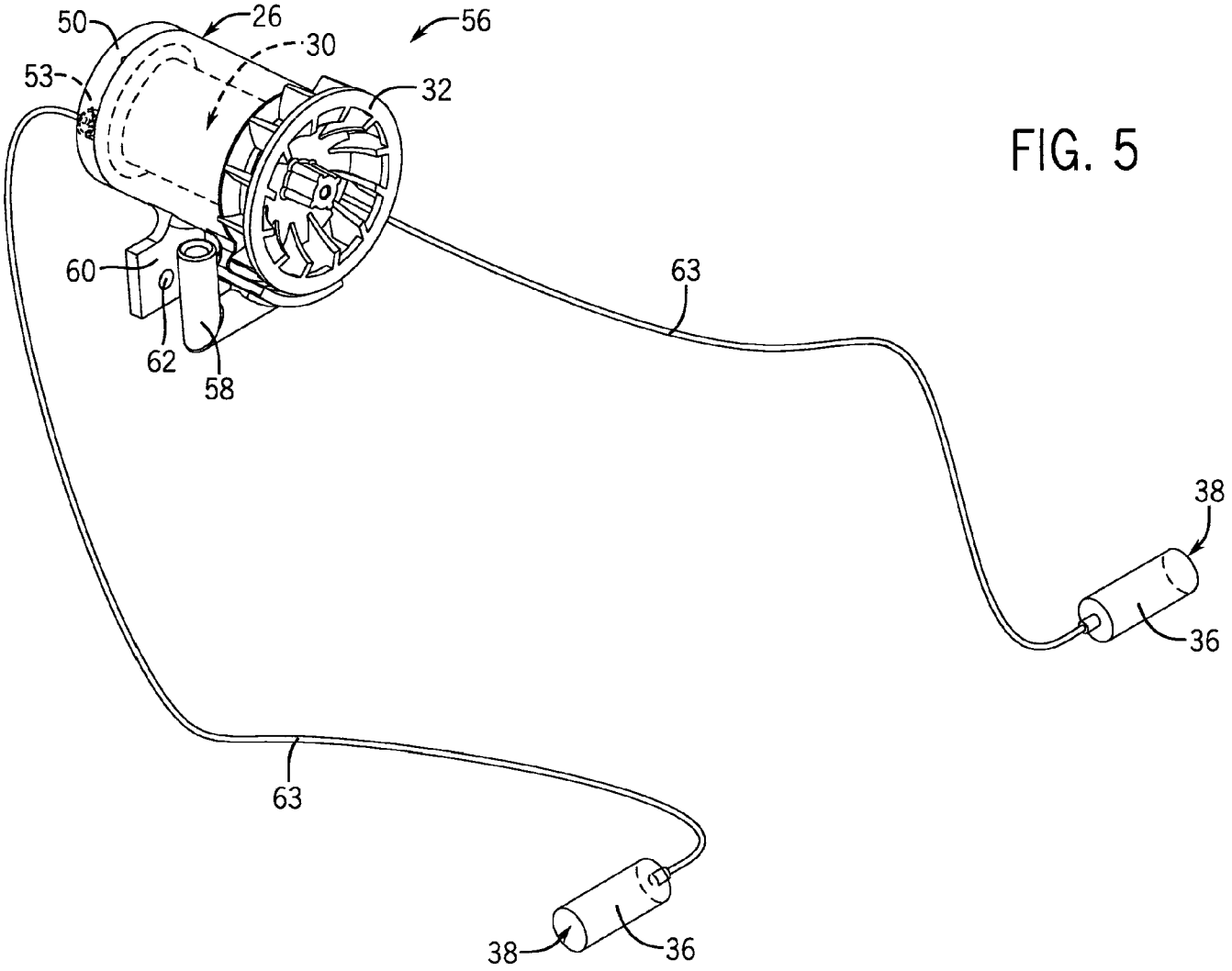
FIG. 5 is a perspective view of an internal LED module according to another embodiment of the invention.

FIG. 5 illustrates an internal LED module 56 according to another embodiment of the invention. The internal LED module 56 can operate similar to the in-line LED module 10 described above and can be positioned inside the pool cleaner 12 and at least partially within the fluid path of the pool cleaner 12. In general, the fluid path of the pool cleaner 12 can include any components in which fluid is directed through the pool cleaner 12, such as the pool hose attachment adapter 16, the supply mast 14, a sweep hose jet, a distributer manifold, thrust jets, a timing assembly, a hydraulic drive wheel assembly, a vacuum assembly, etc.

Figure 6:
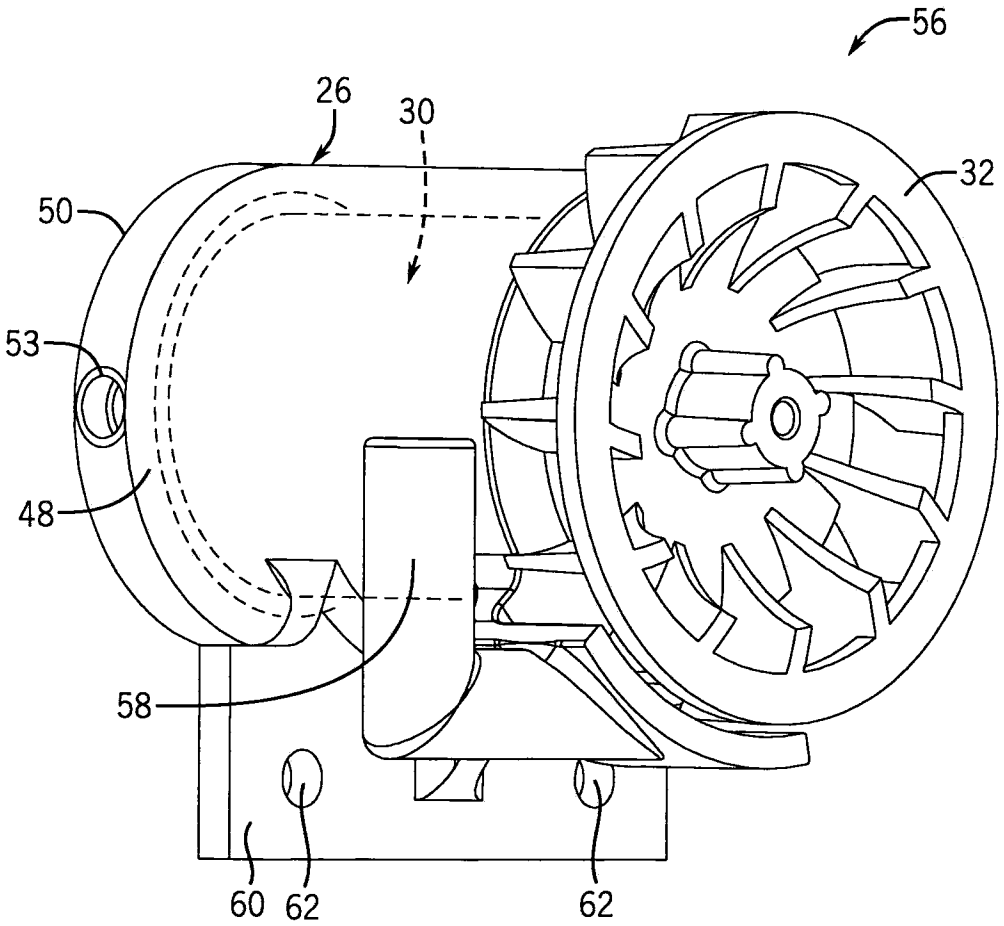
FIG. 6 is a partial perspective view of the internal LED module of FIG. 5.

The internal LED module 56 can include an outer housing 26, a paddle wheel 32, a lead cover 50, lead cables 63, and LEDs 38. The outer housing 26 can house a generator 30, which can be coupled to a paddle wheel 32 via a generator shaft and can be substantially sealed off from the paddle wheel 32 by a seal plate and a rubber seal ring. As shown in FIGS. 5 and 6, the outer housing 26 can include a flow director 58 that directs water flow from the fluid path across the paddle wheel 32. As a result, the paddle wheel 32 rotates, causing rotation of the generator shaft to generate power for the LEDs 38.

The internal LED module 56 can be positioned at any location within the pool cleaner 12 so that the flow director 58 enters the fluid path and receives water flow to redirect to the paddle wheel 32. For example, the internal LED module 56 can be positioned within the pool cleaner 12 so that the flow director 58 extends into the supply mast 14 or a distributor manifold 100 of the pool cleaner 12. As shown in FIG. 9, the distributor manifold 100 can substantially encircle a suction mast 101 of the pool cleaner 12 and can receive fluid flow from the supply mast 14. Generally, the fluid path leads from the supply mast 14 to the distributor manifold 100 and the distributor manifold 100 distributes the fluid path of water flow received by the supply mast 14 to various portions of the pool cleaner 12 for operation, such as a fluid outlet 102 for a timer assembly (not shown), a sweep hose jet 104, a vacuum assembly 106, etc. In another example, the internal LED module 56 can be positioned downstream from the distributor manifold 100 (i.e., in comparison to upstream from the distributor manifold near the supply mast 14) and closer to the timer assembly, the sweep hose jet 104, the vacuum assembly 106, or other hydraulically operated assemblies of the pool cleaner 12. The outer housing 26 can include a mounting portion 60 with through holes 62 to allow an operator to couple the internal LED module 56 to a chassis 108 or other component within the pool cleaner 12 using fasteners (not shown).

Referring back to the generator 30 in FIGS. 5 and 6, a second side 48 of the generator 30 is enclosed in the outer housing 26 by the lead cover 50. The lead cover 50 allows access for lead cables 63 to connect to leads 52 on the generator 30 (e.g., through lead openings 53 in the lead cover 50). The lead openings 53 can extend from sides of the of the lead cover 50, as shown in FIGS. 5 and 6, or can extend from a back end of the lead cover 50, as shown in the lead cover 50 of FIGS. 1-4 with respect to the in-line LED module 10. The lead cables 63 are further connected to the LEDs 36 (e.g., with LED housings 38, as shown in FIGS. 5 and 6) in order to provide power and/or control to the LEDs 38. The LEDs 38 can include control circuitry (e.g., internal control circuitry adjacent to the LEDs 38 and/or external control circuitry housed within the outer housing 26) to control the illumination time and/or color of the LEDs 38.

The LEDs 38 can be positioned at one or more locations along the pool cleaner 12 to illuminate the surrounding area of the pool cleaner 12. For example, the LEDs 38 can be positioned at locations near the bottom sides of the pool cleaner 12 to illuminate the pool floor or walls near the pool cleaner 12. In another example, the LEDs 38 can be positioned at locations near the front of the pool cleaner 12 to illuminate debris in the path of the pool cleaner 12. In another example, the LEDs 38 can be positioned at locations near the back side of the pool cleaner 12 to illuminate a whiptail (not shown) trailing the pool cleaner 12 to scrub pool surfaces. The LEDs 38 can be positioned substantially outside the pool cleaner 12, or can be at least partially recessed within the pool cleaner 12 and protected by outer covers 64 (as shown in FIG. 1) of the pool cleaner 12. In either such embodiment, the outer covers 64 can be removable to allow removal or replacement of the LEDs 38, the lead cables 63, and/or the internal LED module 56.

Figure 7:
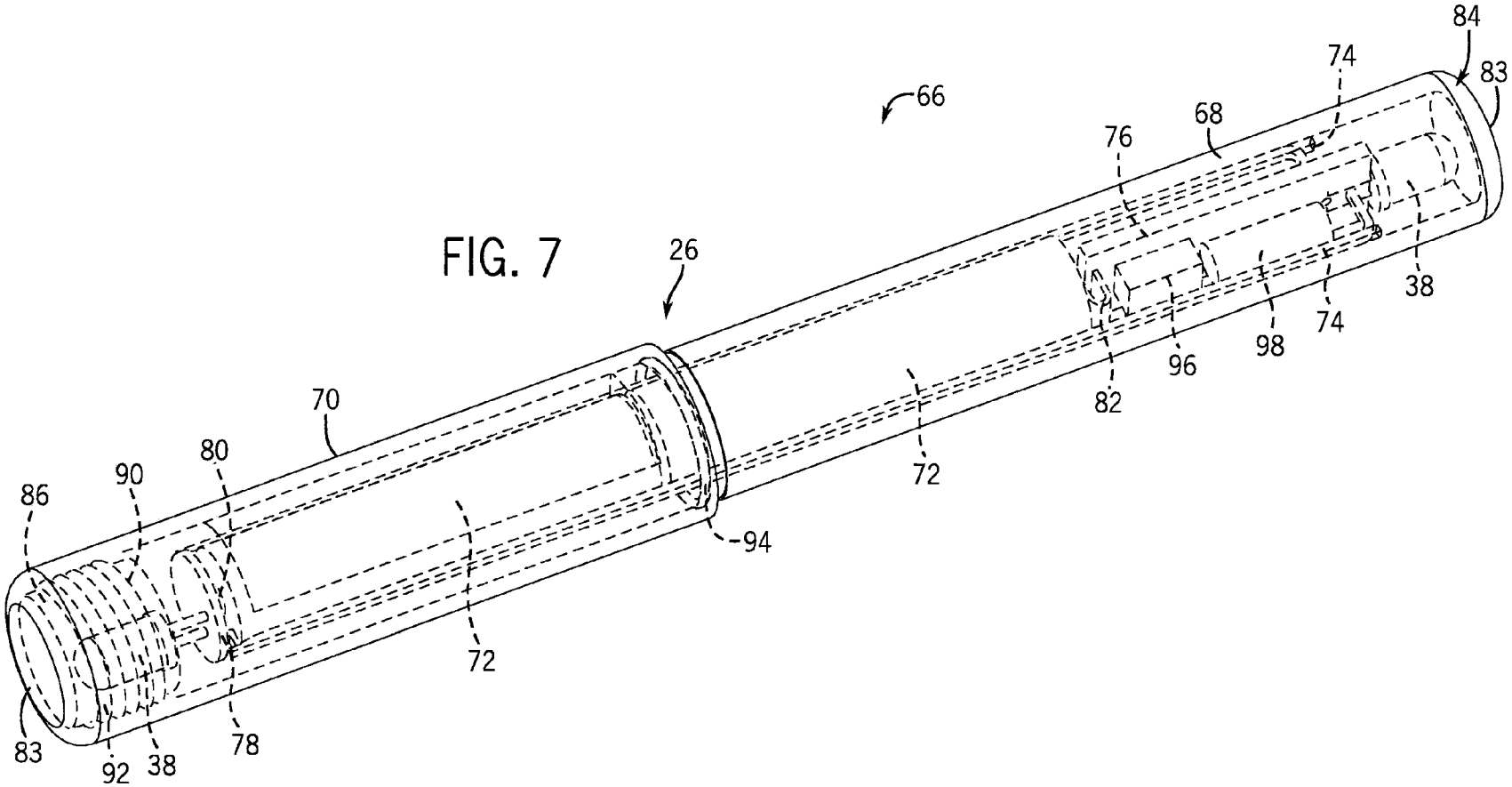
FIG. 7 is a perspective view of an LED tube module according to yet another embodiment of the invention.

FIG. 7 illustrates an LED tube module 66 according to another embodiment of the invention. The LED tube module 66 can be removably attached to a mounting assembly (not shown) on one of the outer covers 64 of the pool cleaner 12. The LED tube module 66 can include a holder 68, a cap 70, one or more batteries 72, shims 74, a first printed circuit board (PCB) 76, a second PCB 78, and LEDs 38. The first PCB 76 and the second PCB 78 can be positioned along opposite ends of the LED tube module 66 and can be connected by the shims 74. The batteries 72 can be held in place between the first PCB 76, the second PCB 78, and the two shims 74, as shown in FIG. 7. The second PCB 78 can include a battery spring 80 and the first PCB 76 can include a battery tab 82, or vice versa, in order to connect to terminals of the batteries 72 for powering circuitry on the first PCB 76 and/or the second PCB 78 as well as the LEDs 38. The LEDs 38 can be connected to the first PCB 76 or the second PCB 78 and directed toward outward ends of the LED tube module 66 in order to illuminate both ends of the LED tube module 66. Accordingly, either end of the LED tube module 66 (e.g., end portions of both the holder 68 and the cap 70) can include transparent portions 83 to allow light from the LEDs 38 to illuminate outward from the LED tube module 66. In some embodiments, the entire outer housing 26 of the LED tube module 66 (i.e., including the holder 68 and the cap 70) can be constructed of transparent material.

Figure 8:
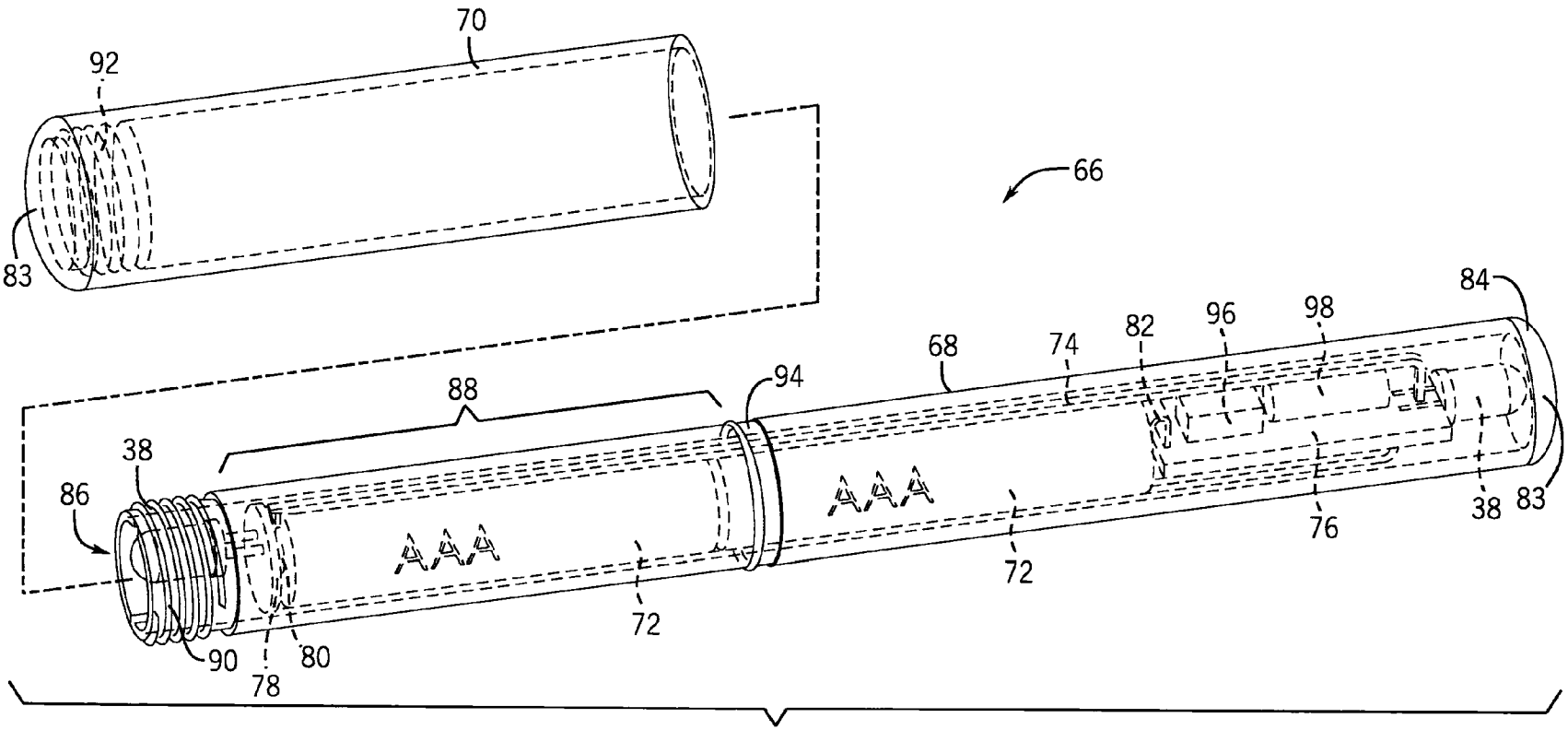
FIG. 8 is an exploded perspective view of the LED tube module of FIG. 7.

The holder 68 and the cap 70 can form a water-tight housing 26 around the LEDs 38, the batteries 72, the first PCB 76, and the second PCB 78. According to one embodiment of the invention, as shown in FIG. 8, the holder 68 can include a first closed end 84 and a second open end 86 and can extend a portion of the total length of the LED tube module 66. Adjacent to the second end 86, the holder 68 can include an opening 88, as shown in FIG. 8, sized to allow insertion of the batteries 72 between the first PCB 76 and the second PCB 78. The cap 70 can extend a portion of the total length of the LED tube module 66 in order to at least cover the second open end 86 and the opening 88 of the holder 68 when the cap 70 is assembled over the holder 68. As shown in FIG. 8, the second open end 86 of the holder 68 can include a threaded portion 90, and an inner end of the cap 70 can include a mating threaded portion 92 for coupling together the holder 68 and the cap 70. As a result, the holder 68 and the cap 70 can be screwed apart to provide access inside the LED tube module 66 for replacing the batteries 72 or the LEDs 38.

As described above, the holder 68 and the cap 70 can provide a water-tight outer housing 26 for the LEDs 38, the first PCB 76, the second PCB 78, and the batteries 72. More specifically, to prevent water from entering the LED tube module 66 when is it assembled, an o-ring 94 can be fitted over the holder 68 between the first closed end 84 and the opening 88 and can engage the cap 70 when the cap 70 and the holder 68 are assembled or screwed together (i.e., via the mating threaded portions 90, 92).

The LED tube module 66 can be attached to the pool cleaner 12 at any location along the pool cleaner's outer surface, for example onto a mounting assembly on one of the covers 64 of the pool cleaner 12. Therefore, a user can detach the LED tube module 66 from the attachment portion in order to use it as an external light under or above water, to replace the batteries 72, to replace the LEDs 38, etc. The first PCB 76 can include circuitry such as one or more capacitors 96 and a motion sensor 98. The motion sensor 98 can be used to detect substantial movement of the pool cleaner 12 (e.g., movement indicative of pool cleaner operation) and can be connected to the internal control circuitry of the LEDs 38 to signal operation of the LEDs 38 only when the pool cleaner 12 is in motion. In another embodiment, the LED tube module 66 can be attached to a chassis of the pool cleaner 12 or an underside of one of the covers 64, and the LEDs 38 can illuminate through grating, holes, or transparent portions in the covers 64.

The above embodiments of LED modules 10, 56, 66 describe illuminating the LEDs 38 when the pool cleaner 12 is in operation, either through electric power generation when the pool cleaner 12 is receiving water from a pool hose or through battery power based on motion sensor signals. Therefore, the LEDs 38 can provide functional as well as aesthetic uses. More specifically, the illuminated LEDs 38 can provide a quick signal to an operator that the pool cleaner 12 is in operation. In some embodiments, the control circuitry of the LEDs 38 and/or additional control circuitry of the LED modules 10, 56, 66 (such as the external control circuitry in the generator housing 28 or on the first PCB 76) can control the color and/or illumination time of the LEDs 38 based on the water pressure entering the pool cleaner 12, for the hydraulically powered LED modules 10, 56, or the speed of the pool cleaner 12, for the battery-powered LED tube module 66. For example, if the pool cleaner 12 is receiving insufficient water pressure, and as a result is not vacuuming properly, the paddle wheel 32 of the LED modules 10, 56 will rotate slower. Also, if the pool cleaner 12 is moving slower, for example due to an obstruction, a mechanical failure, etc., the motion sensor 98 may not signal or may emit different signals to the control circuitry. Either event can be communicated to the operator by operating the LEDs 38 with a different color (e.g., green for sufficient flow or movement speed, red for insufficient flow or movement speed) or at a different rate (e.g., constant illumination for sufficient flow or movement speed, flashing for insufficient flow or movement speed).

In addition, the LED control circuitry can operate the LEDs 38 in a single color mode (i.e., where all LEDs 38 illuminate the same color), a multi-color mode (i.e., where different LEDs 38 illuminate different colors, for example where one side of the pool cleaner 12 is illuminated red and the other side of the pool cleaner 12 is illuminated purple), or a color-changing mode (i.e., where the LEDs 38 illuminate a first color for a first time period, then a second color for a second time period, etc.). The color-changing mode may convey to an operator as to when the pool cleaner 12 will be done operating. For example, the LEDs 38 may be illuminated in a first color during most of the pool cleaner operation, and then illuminated in a second color during the last ten minutes of the pool cleaner operation so that the operator knows that the pool cleaner operation is almost completed. Each of the LED modules 10, 56, 66 can be easily removed from the pool cleaner 12 to allow repair or replacement of components, such as LEDs 38, generators 30, batteries 72, etc.

Furthermore, in some embodiments of the invention, the LED modules 10, 56, 66 may be capable of connecting to a power supply and/or a controller (not shown) of the pool cleaner 12. The power supply can assist powering the LEDs 38, while the controller can provide additional information about the pool cleaner 12 in order to illuminate the LEDs 38 in accordance with other operations of the pool cleaner 12. For example, the pool cleaner controller can include a sensor to determine when the debris bag needs to be emptied. The pool cleaner controller can communicate this needed action to the LED control circuitry, and the LED control circuitry can illuminate the LEDs 38 in a manner to alert the operator of the needed action.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A light module for a swimming pool cleaner, the light module comprising:

an outer housing capable of being removably coupled to the swimming pool cleaner and including a flow directing portion positioned in a fluid path of the swimming pool cleaner, the outer housing including a mounting portion capable of being coupled to a chassis of the swimming pool cleaner;

a paddle wheel located adjacent to the flow directing portion, the paddle wheel rotating in response to fluid flow through the fluid path;

a generator coupled to the paddle wheel that generates power through rotation of the paddle wheel; and at least one light emitting diode coupled to the generator, the at least one light emitting diode receiving the generated power from the generator and illuminating an area adjacent to the swimming pool cleaner.

2. The light module of claim 1, wherein the outer housing is capable of being coupled between a supply mast of the swimming pool cleaner and a pool hose attachment adapter.

3. The light module of claim 2, wherein the outer housing is coupled to the supply mast by a snap fit connection and the outer housing is coupled to the pool hose attachment adapter by a press fit connection.

4. The light module of claim 1, wherein the at least one light emitting diode is positioned within a light emitting diode housing one of coupled to and integral with the outer housing.

5. The light module of claim 1, wherein the paddle wheel is positioned within the outer housing.

6. The light module of claim 1, wherein the paddle wheel and the generator are substantially separated by a seal cap and a rubber ring, wherein a shaft of the generator extends through the seal cap and the rubber ring and is coupled to the paddle wheel.

7. The light module of claim 6, wherein the outer housing includes a generator housing separate from the flow directing portion, the generator being substantially enclosed by the generator housing, the seal cap, and a lead cover.

8. The light module of claim 1, and further comprising at least one lead cable that connects the at least one LED to the generator.

9. The light module of claim 1, wherein the at least one light emitting diode includes control circuitry that controls at least one of illumination and color of the at least one light emitting diode.

10. The light module of claim 1, wherein the outer housing is capable of being positioned inside the pool cleaner so that the flow directing portion at least extends into one of a supply mast and a distributor manifold of the swimming pool cleaner.

11. The light module of claim 1, wherein the paddle wheel is positioned outside of the outer housing.

12. A pool cleaner receiving fluid flow from a pool hose, the pool cleaner comprising:

a supply mast; and a light module including a housing capable of being removably coupled to the supply mast and the pool hose, the housing directing fluid flow from the pool hose to the supply mast;

a generator positioned inside the housing;

a paddle wheel coupled to the generator, the paddle wheel and the generator generating electric power using the fluid flow directed through the housing; and at least one light emitting diode coupled to the generator, the at least one light emitting diode receiving the generated power from the generator and illuminating an area adjacent to the pool cleaner.

13. The pool cleaner of claim 12, wherein the at least one light emitting diode is positioned in the housing and directs light away from the housing to illuminate at least one of a swimming pool wall and a swimming pool floor.

14. The pool cleaner of claim 12 and further comprising light emitting diode control circuitry that controls the at least one light emitting diode to illuminate in one of a single-color mode, a multi-color mode, and a color changing mode.

15. The pool cleaner of claim 12, wherein the housing is coupled to the pool hose by a hose attachment adapter.

16. A method of operating a pool cleaner, the method comprising the steps of:

receiving fluid flow through the pool cleaner;

generating electric power using a paddle wheel positioned to receive at least some of the fluid flow and a generator coupled to the paddle wheel;

determining a pressure of the fluid flow;

operating at least one light emitting diode using the generated electric power according to a first operation if the pressure is sufficient for normal operation of the pool cleaner; and operating the at least one light emitting diode using the generated electric power according to a second operation if the pressure is insufficient for normal operation of the pool cleaner.

17. The method of claim 16, wherein the first operation includes operating the at least one light emitting diode to emit a first color and the second operation includes operating the at least one light emitting diode to emit a second color different than the first color.

18. The method of claim 16, wherein the first operation includes operating the at least one light emitting diode to emit a constantly visible light and the second operation includes operating the at least one light emitting diode to emit a flashing light.

19. The method of claim 16, wherein the first operation includes operating the at least one light emitting diode to emit a first color as a constantly visible light and the second operation includes operating the at least one light emitting diode to emit a second color different than the first color as a flashing light.

20. The method of claim 16, wherein the first operation includes operating the at least one light emitting diode to emit a flashing light at a first frequency and the second operation includes operating the at least one light emitting diode to emit a flashing light at a second frequency different than the first frequency.

* * * * *